United States Patent [19]

Ito

[11] 4,069,658

[45] Jan. 24, 1978

[54] ALARM SETTING DEVICE FOR TIMEPIECES

[75] Inventor: Hiroshi Ito, Showamachi, Japan

[73] Assignee: Rhythm Watch Co. Ltd., Tokyo, Japan

[21] Appl. No.: 752,320

[22] Filed: Dec. 20, 1976

[30] Foreign Application Priority Data

Dec. 22, 1975 Japan ..... 50-153807

[51] Int. Cl.[2] ..... G04B 29/04

[52] U.S. Cl. ..... 58/16 R; 58/38 R

[58] Field of Search ..... 58/7, 9, 16, 22, 38, 58/57.5

[56] References Cited

U.S. PATENT DOCUMENTS

| | | | |
|---|---|---|---|
| 2,779,150 | 1/1957 | Chartier et al. | 58/16 |
| 3,387,452 | 6/1968 | Ring et al. | 58/16 |
| 3,498,046 | 3/1970 | Jepson et al. | 58/16 |
| 3,603,074 | 9/1971 | Ganter | 58/16 |
| 3,783,599 | 1/1974 | Tanaka | 58/38 R |
| 3,996,734 | 12/1976 | Kitai et al. | 58/38 R |

*Primary Examiner*—Robert K. Schaefer
*Assistant Examiner*—Vit W. Miska
*Attorney, Agent, or Firm*—Koda and Androlia

[57] ABSTRACT

An alarm setting device for timepieces consisting of a primary alarm setting wheel which engages an alarm hand wheel, a primary time wheel which is provided on the same shaft as the primary alarm setting wheel and which is driven by a wheel train of the timepiece, a primary cam mechanism which includes projections and engaging slots provided on the primary time wheel and in the primary alarm setting wheel, a secondary alarm setting wheel which engages with the primary alarm setting wheel, a secondary time wheel which is provided on the same shaft as the secondary alarm setting wheel and which is driven at a higher rate than that of the primary time wheel by a wheel train of the timepiece, a secondary cam mechanism which includes projections and engaging slots provided on the secondary time wheel and in the secondary alarm setting wheel and whose dropping and riding-up actions follow those of the primary cam mechanism, and a contact device which contains a movable part which is engaged by the primary and secondary time wheels and activated by the primary and secondary cam mechanisms and in which the on-off condition of the contact device is controlled by the movable part.

5 Claims, 18 Drawing Figures

FIG. 11A
FIG. 11B
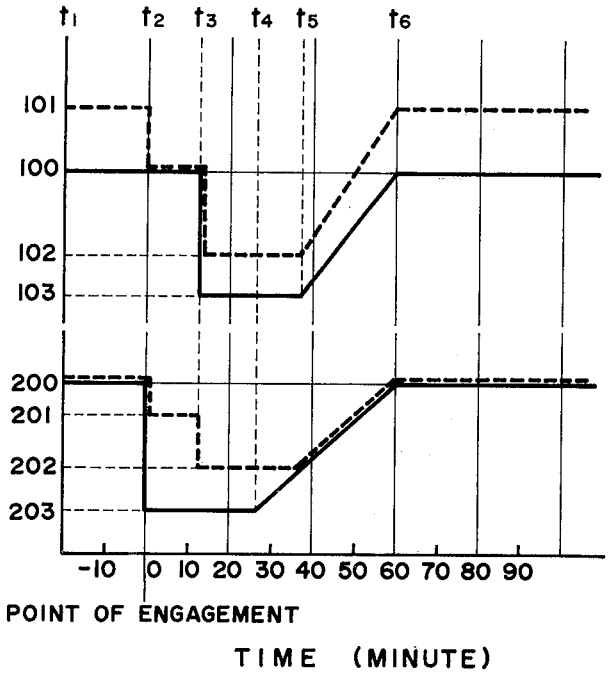
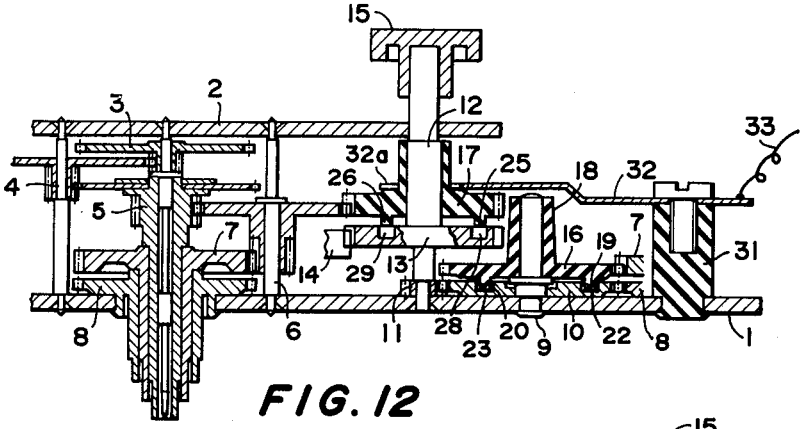
FIG. 12
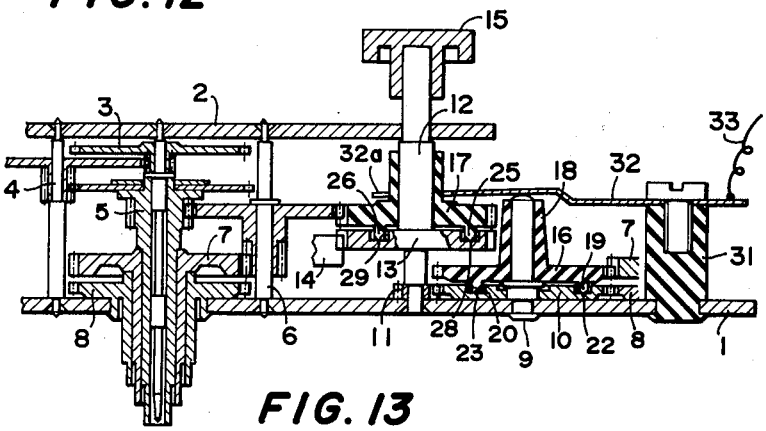
FIG. 13

ALARM SETTING DEVICE FOR TIMEPIECES

BACKGROUND OF THE INVENTION

1. Field of Invention

This invention relates to timepieces with alarms and more particularly to means for setting the alarm time in a timepiece.

2. Prior Art

Electronic timepieces such as tuning leaf timepieces, tuning fork timepieces, quartz crystal timepieces, etc., offer greater precision than conventional mechanical timepieces. In cases where acoustic alarm devices have been installed in these timepieces, however, they have suffered from a major drawback. The drawback is that the improved precision of the timepiece has not effectively contributed to the acoustic alarm action due to the fact that the accuracy with which the time at which the alarm sounds can be set is poor. Normally, in conventional alarm setting devices, the acoustic alarm signal is produced by a cam mechanism installed between an hour hand wheel which revolves at an extremely low rate of one revolution in 12 or 24 hours and a corresponding alarm setting wheel. In such a conventional device, the accuracy with which the time at which the alarm sounds can be set is determined by the degree of precision of the parts of the cam mechanism, the excentricity or bearing clearance of the hour hand wheel and the alarm setting wheel, etc. Accordingly, in the case of a cam mechanism installed on the slowly revolving hour hand wheel, variations in the degree of mechanical precision have a great effect upon the degree of accuracy with which time at which the alarm sounds can be set. Therefore, since there are limits to the extent to which the degree of precision of the various parts can be improved, a reduction in the degree of accuracy with which the time at which the alarm sounds can be set is unavoidable.

A device which contains a primary cam mechanism which acts in conjunction with the hour hand wheel and a secondary cam mechanism which acts in conjunction with a wheel which revolves at a higher rate than the hour hand wheel, in which the degree of accuracy with which the time at which the alarm sounds can be set has been improved by combining separate contacts whose on-off conditions are controlled by two cam mechanisms, has been proposed in the past as an improved alarm setting device.

However, this improved device suffers from several drawbacks. First, simplicity of assembly suffers due to the increase in the number of parts and the probability of electrical contact malfunction is increased. Secondly, the load of the cam mechanism on the wheel turning at a higher rate causes the timepiece to lose driving torque and therefore exerts a deleterious effect upon the precision of the timepiece. This last effect is understandable in view of the fact that despite its small rotational torque, the wheel revolving at a higher rate requires at least a certain amount of operating force in order to obtain sufficient contact pressure to insure good contact.

This invention has been designed with the above mentioned conventional problems in mind.

SUMMARY OF THE INVENTION

Accordingly, it is a general object of the present invention to provide an alarm setting device which allows the time at which the alarm sounds to be set with a high degree of accuracy.

It is still another purpose of the present invention to provide an alarm setting device which is easy to assemble.

It is still another object of the present invention to provide an alarm setting device which is easy to operate.

In keeping with the principals of the present invention, the objects are accomplished with a unique alarm setting device for timepieces including a primary alarm setting wheel which engages an alarm hand wheel, a primary time wheel which is provided on the same shaft as the primary alarm setting wheel and which is driven by a wheel train of the timepiece, a primary cam mechanism which includes projections and engaging slots provided on the primary time wheel and in the primary alarm setting wheel, a secondary alarm setting wheel which engages with the primary alarm setting wheel, a secondary time wheel which is mounted on the same shaft as the secondary alarm setting wheel and which is driven at a higher rate than that of the primary time wheel by a wheel train of the timepiece, a secondary cam mechanism which includes projections and engaging slots provided on the secondary time wheel and in the secondary alarm setting wheel and whose dropping in and riding-up actions follow those of the primary cam mechanism and a contact means which includes a movable part which is engaged by the primary and secondary wheels and activated by the primary and secondary cam mechanisms and which controls the on-off condition of the contact means. dr

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which:

FIGS 11A and 11B are time charts which illustrate the operation of the embodiment of FIG. 1;

FIGS. 12 and 13 are cross-sectional views which illustrate the various conditions of operation of the embodiment of FIG. 1;

DETAILED DESCRIPTION OF THE INVENTION

Figure 1:
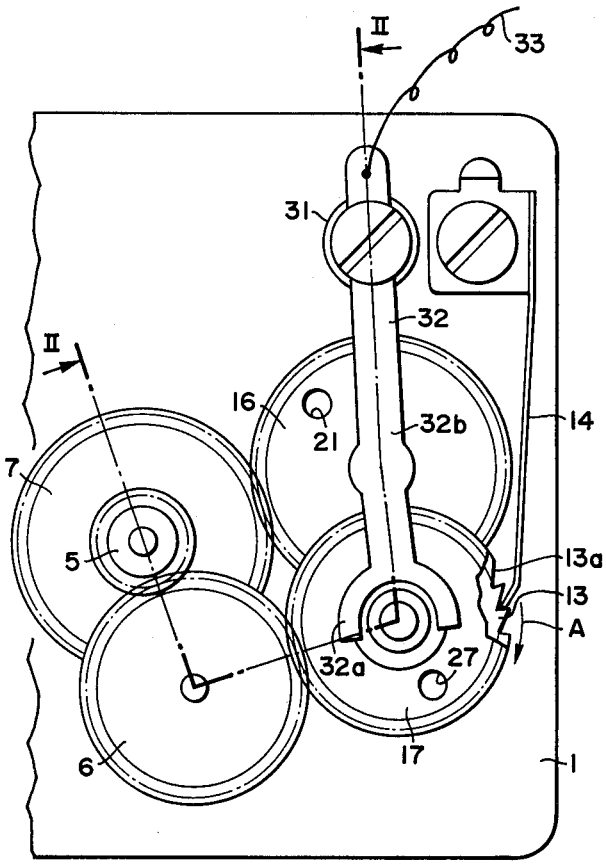
FIG. 1 is a plan view of an alarm setting device in accordance with the teachings of the present invention.
Figure 2:
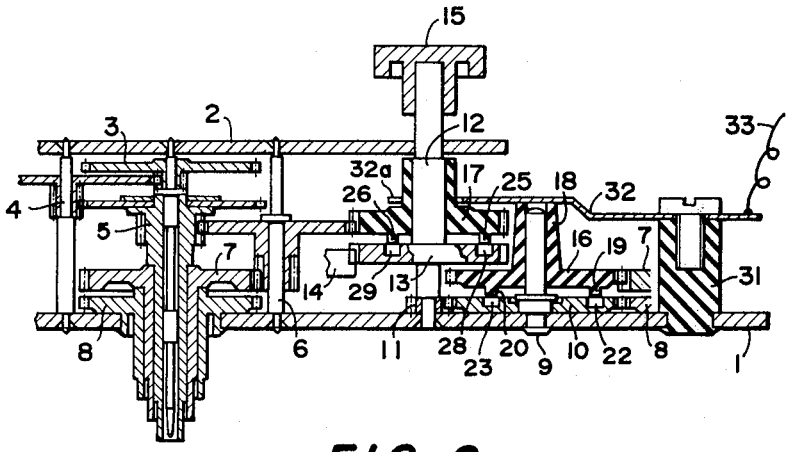
FIG. 2 is a unfolded cross-sectional view along the lines II—II in FIG. 1.

Referring more particularly to the drawings, FIG. 1 illustrates the arrangement of the principal wheel trains of a timepiece which includes an alarm setting device in accordance with the teachings of the present invention. FIG. 2 is an unfolded cross-sectional view along the lines II—II in FIG. 1. In FIG. 2, some of the gears and other parts have been shown in duplicate in order to illustrate the arrangement of each wheel train.

FIG. 2, a bottom plate 1 and a top plate 2 form the movement case of a timepiece. The alarm time setting wheel train and other timepiece wheel trains, etc., are mounted on pivoted arbors between the bottom plate 1 and the top plate 2. A seconds hand wheel 3 is rotatably provided between bottom plate 1 and top plate 2 and is driven by a speed regulating driving source (not shown). Seconds are indicated by a seconds hand which is attached to an extension of this wheel. A revolution of the seconds hand wheel 3 is transmitted to a minute hand wheel 5 via a third wheel 4. Minutes are indicated by a minute hand which is attached to an extension of the minute hand wheel 5. Furthermore, revolution of the minute hand wheel 5 is transmitted to the hour hand wheel 7 via minute wheel 6. Hours are indicated by an hour hand which is attached to an extension of the hour hand wheel 7. Thus, a driving signal is transmitted from a source which provides a time standard, e.g., a tuning leaf, tuning fork or quartz crystal, etc., to the indicator hand via the wheel trains of the timepiece.

On alarm hand wheel 8 is provided on the same arbor as the hour hand wheel 17 and revolves together with the hour hand wheel 7. The time at which the alarm has been set to sound is indicated by the alarm hand which is attached to an extension of the alarm hand wheel 8. A primarily alarm setting wheel 10 mounting on a contact axle 9 which is perpendicular to the bottom plate 1 engages with alarm hand wheel 8. The contact axle 9 is made from a material which a good conductor of electricity, i.e., metal, etc. One end of contact axle 9 is electrically connected to an acoustic alarm device by a nut, not shown, and the bottom plate 1. The other end of contact axle 9 forms a contact point. The primary alarm sitting wheel 10 engages with alarm setting pinion 11. Alarm setting pinion 11 is rigidly attached to the alarm setting stem 12 which is provided between the bottom plate 1 and the top plate 2. A secondary alarm setting wheel 13 is also rigidly attached to alarm setting stem 12. Ratchet teeth 13*a* are provided on secondary alarm setting wheel 13 and engaged with paw spring 14 such that revolution of alarm setting wheel 13 is only allowed in the direction indicated by arrow A in FIG. 1. An alarm setting crown 15 is rigidly mounted on the projecting end of alarm setting stem 12. The time at which the alarm will sound as set by rotating the primary alarm setting wheel 10 and the secondary alarm setting wheel 13 for the desired time as indicated by the alarm hand wheel 8.

In addition to the alarm setting wheel train, the alarm setting mechanism also contains a primary time wheel 16 and a secondary time wheel 17 which correspond to the alarm settings wheels 10 and 13. The primary time wheel 16 is provided on contact axle 9 and engages with the hour hand wheel 7. The primary time wheel 16 is made of an electrically insulating material such as a synthetic resin, etc. The hollow shaft portion 18 of primary time wheel 16 extends upward along the contact axle 9 as shown in FIG. 2. The primary on off condition of the contact 9 is determined by whether or not the tip of the hollow shaft part 18 projects beyond the tip of contact axle 9.

Figure 3:
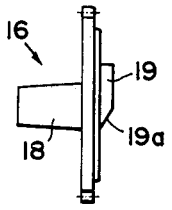
FIG. 3 is a front view of the primary time wheel of an alarm setting device in accordance with the teachings of the present invention.
Figure 4:
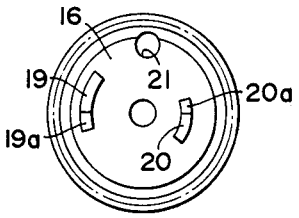
FIG. 4 is a right side view of FIG. 3.

Primary time wheel 16 is illustrated in greater detail in FIGS. 3 and 4. Projections 19 and 20, which form the primary cam mechanism, are provided on the underside surface of wheel 16. These projections 19 and 20 are each located at a different distance from the center of wheel 16 so that the projections 19 and 20 past their activating position once during each revolution and so that lag or unstable rotation of the primary time wheel 16 is prevented during revolution. On inclined cam faced 19*a* and 20*a* is formed in one end of each of the projections 19 and 20 respectively. An aperature 21 is provided through primary time wheel 16. The aperature 21 is suitable for use for a device for determining the proper position of wheel 16 during assembly of the alarm setting wheel train.

Figure 5:
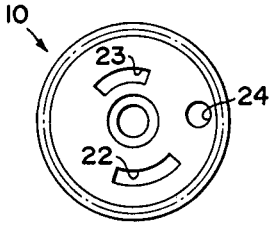
FIG. 5 is a front view of a primary alarm setting wheel for an alarm setting device in accordance with the teachings of the present invention.
Figure 6:
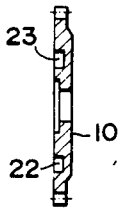
FIG. 6 is a cross-section of the primary alarm setting wheel of FIG. 5.

The primary alarm setting wheel 10 is shown in more detail in FIGS. 5 and 6. The primary alarm setting wheel 10 has slots 23 and 24 formed therein which correspond to the projections 19 and 20 on the primary time wheel 16. On aperature 24 as further provided in primary alarm sitting wheel 10 which corresponds to the aperature 21 in the primary time wheel 16.

Figure 7:
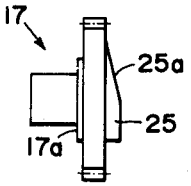
FIG. 7 is a front view of a secondary time wheel for an alarm setting device in accordance with the teachings of the present invention.
Figure 8:
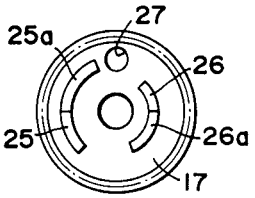
FIG. 8 is a right side view of the secondary time wheel of FIG. 7.

Secondary time wheel 17 is made of electrically insulated material such as a synthetic resin, etc. Secondary time wheel 17 is rotatably mounted on alarm setting stem 13 and is driven by minute wheel 6. The secondary time wheel 17 is illustrated in greater detail in FIGS. 7 and 8. Projections 25 and 26 which form the secondary cam mechanism are provided on the underside surface of secondary time wheel 17. As in the case of projections 19 and 20, these projections 25 and 26 are each located at a different distance from the center of wheel 17 and each has an incline cam surface 25*a* and 26*a*. Furthermore, aperature 27 which is used for positioning, is provided through the secondary time wheel 17.

Figure 9:
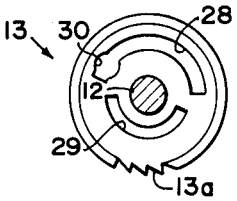
FIG. 9 is a front view of a secondary alarm setting wheel for an alarm setting device in accordance with the teachings of the present invention.
Figure 10:
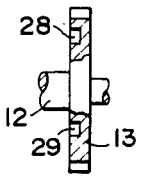
FIG. 10 is a cross-sectional view of the essential parts of FIG. 9.

The secondary alarm setting wheel 13 is shown in greater detail in FIGS. 9 and 10. Slots 28 and 29 which correspond to projections 25 and 26 on a secondary time wheel 17 are provided in secondary alarm wheel 13. An aperature 30 which corresponds to aperature 27 is also formed in secondary alarm wheel 13.

Contact spring 32, which forms a movable part, is fastened by means of a screw to supporting post 31 which is perpendicular to bottom plate 1. Supporting post 31 is made of an electrically insulated material such as synthetic resin, etc. As is shown in FIG. 2, the tip of contact spring 32 extends to a position adjacent to shoulder 17*a* of secondary time wheel 17 and an intermediate portion of spring 32 is in contact with the upper portion of primary time wheel 16 so that the primary time wheel 16 is forced downwardly. The other end of contact spring 32 is electrically coupled to an acoustic alarm device (not shown) via a lead wire 33. The number of teeth on the primary time wheel 16 is equal to the number on the hour hand wheel 7 and the number of teeth on the secondary time wheel 17 are equal to the number of teeth on the minute wheel 6. Also the number of teeth on primary alarm setting wheel 10 is equal to that on the alarm hand wheel 8. Furthermore, the revolution ratio of primary alarm setting wheel 10 to secondary alarm setting wheel 13 is equal to the revolution ratio of the hour hand wheel 7 to the minute wheel 6.

In operation, the time at which the alarm will sound is set by moving the primary and secondary alarm setting wheels 10 and 13 into the desired position by rotating the alarm setting crown 15. The alarm set time is indicated by the alarm hand attached to the alarm hand wheel 8. The attachment of an alarm hand to the end of alarm setting stem 12 could also be used as an accurate indication of the time at which the alarm is set.

In FIG. 11A the change in position of the shoulder 17*a* of secondary time wheel 17 relative to the lapsed time as indicated by a solid line and the accompaning change and position of the tip 32*a* of the contact spring 32 is indicated by a broken line. In FIG. 11B, the change in the position of the tip of the hollow shaft part 18 of primary time wheel 16 relative to a lasped time as indicated by the solid line and the accompaning changed position of the intermediate portion 32*c* of the contact spring 32 is indicated by a broken line.

The condition shown in FIG. 2 is indicated by the positions shown between $t_1$ and $t_2$ in FIGS. 11A and 11B. Here, both primary and secondary cam mechanisms are in a riding-up condition. Specifically, since the projections 19 and 20 on the secondary time wheel 16 do not correspond with the slots 22 and 23 in the primary alarm setting wheel 10, the hollow shaft part 18 projects beyond the contact axle 9 so that the intermediate portion 13*b* of contact spring 32 is held in the position 200 of FIG. 11B. Accordingly, there is no contact between the contact spring 32 and the contact axle 9 and the acoustic alarm device in maintained in the unactivated condition. During this period of time, since the projections 25 and 26 on the secondary time wheel 17 do not coincide with slots 28 and 29 on secondary alarm setting wheel 13, the shoulder 17*a* of wheel 17 is maintained in position 100 of 11A. Since in this embodiment the position of contact spring 32 is determined by the position of the primary time wheel as described above, the tip 32*a* of the contact spring is held in position 101 above the shoulder 17*a* and does not come in contact with shoulder 17*a*. The condition shown in FIG. 2, in which the acoustic alarm device kept in an unactivated state is the normal condition of this device. Since this condition is of a long duration of the absense of any pressure on the contact spring 32 on a secondary time wheel 17 which has a small rotational torque is desirable in order to reduce the amount of driving torque required by the time piece.

Time $t_3$ in FIGS. 11A and 11B is the time at which the alarm has been set to sound. The dropping in action of the primary cam mechanism occurs prior to this at time $t_2$. This condition is illustrated in FIG. 12. The projections 19 and 20 on the primary time wheel 16 drop into slots 22 and 23 in the primary alarm setting wheel 10 so that the tip of the hollow shaft part 18 drops down into position 203. As a result of this, the control of the position of the contact spring 32 is relaxed. However, since the secondary cam mechanism is still in a riding-up position, the tip 32*a* of the contact spring moves only as far as position 100 where it comes into contact with shoulder 17*a* of secondary time wheel 17. As it is clearly shown in FIG. 12, the contact spring 32 still fails to make contact with the contact axle 9 and the acoustic alarm device is maintained in an unactivated condition. Since the revolution of the primary time wheel 16 is slow, the accuracy of the time $t_2$ is not very good. However, since the action occuring at this time is merely a preparatory action which occurs prior to the time $t_3$ at which the alarm has been set to sound, the degree of accuracy of time $t_2$ is not a problem.

The dropping-in action of the secondary cam mechanism occurs at time $t_3$. This condition is illustrated in FIG. 13. Specifically, projections 25 and 26 on the secondary time wheel 17 drop into the slots 18 and 29 in the secondary alarm setting wheel 13 so that shoulder 17*a* of wheel 17 drops into position 103. As a result of this, the intermediate portion 32*b* of contact spring 32 drops from position 201 into position 202 and makes contact with contact axle 9. Accordingly, the acoustic alarm devices activated so that it indicates the time at which it has been set to sound. In this condition, the tip 32*a* of contact spring 32 is in position 102, where it does not come into contact with shoulder 17*a* of wheel 17. It is thus apparent that the pressure of the contact spring 32 causes the secondary time wheel 17 to lose rotational torque only during the extremely short period of time between $t_2$ and $t_3$.

The riding-up action of the primary cam mechanism begins at time $t4$ and the riding-up action of the secondary cam mechanism begins later at time $t_5$. The fact that the primary cam mechanism begins to ride up earlier than the secondary cam mechanism is an important feature of this invention. Specifically, since contact spring 32 is moved into its non-contact position (as shown in FIG. 2) by the primary time wheel 16, the contact pressure of contact spring 32 does not act upon secondary time wheel 17 during the change of position of secondary time wheel 17. Accordingly, there is hardly any problem of loss of rotational torque on secondary time wheel 17.

As is clear from the above description, the time at which the alarm sounds is determined by the secondary cam mechanism on the quickly revolving secondary time wheel 17. Accordingly, the degree of accuracy is increased and any deleterious effect upon the accuracy with which the time at which the alarm sounds can be set arising from the degree of precision of the parts of the alarm setting mechanism is reduced. Furthermore, since the contact spring 32 is pushed up by the primary cam mechanism on the slowly revolving primary time wheel 16, it is possible to minimize the amount of driving torque utilized by the time piece. Also, even when the secondary time wheel 17 is in contact with the contact with the contact spring 32 during the period $t_2$ and $t_3$, torque loss is a minimum due to the fact that the wheel 17 contacts only the tip 32*a* of contact spring 32.

Figure 14:
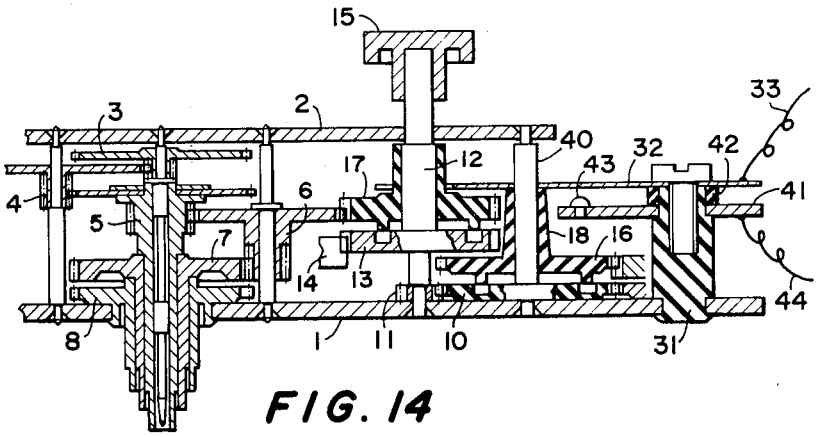
FIG. 14 is a cross-section which illustrates the assembled condition of the essential parts of the embodiment of FIG. 1.

Referring to FIG. 14, shown therein is a second embodiment of an alarm setting device for time pieces in accordance with the teachings of the first invention. Since the second embodiment is similar to the first embodiment, like elements have been given like reference numerals and a description of their operation and connection is omitted. In the second embodiment, an arbor 40 is formed as a unit with the primary time wheel 10. This insulating arbor 40 is rotatably mounted between the bottom plate 1 and the top plate 2. An opening is provided in contact spring 32 and arbor 40 passes through this opening. Therefore, primary time wheel 16 which is provided on arbor 40 makes contact with contact spring 32 about the periphery of the opening. A contact plate 41 is attached to supporting post 31 and an insulating wall 42 is provided between the contact plate 41 and the contact spring 32. Contact point 43 is attached to contact plate 41 so that it faces contact spring 32. Contact plate 41 is coupled to the acoustic alarm device via a lead wire 44. As was the case with the first embodiment, the second embodiment also makes it possible to obtain superior acoustic alarm operation.

In operation the primary cam mechanism and secondary cam mechanism operates substantially the same way as they do in the first embodiment. The only difference is that instead of the contact spring 32 contacting the contact axle 9 to actuate the acoustic alarm, the contact spring 32 contacts the contact point 43 attached to contact plate 41 and actuates the alarm.

Figure 15:
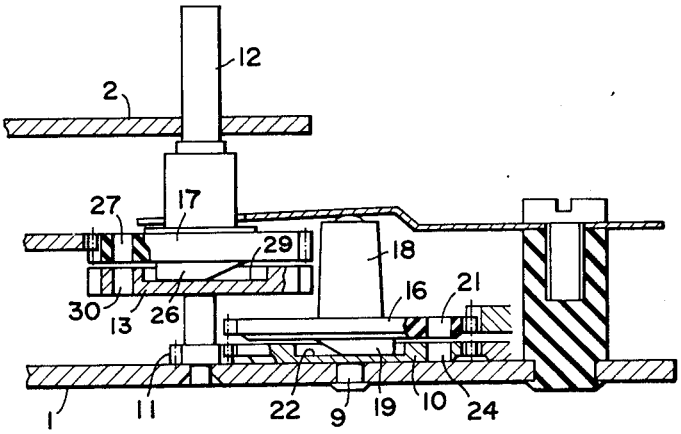
FIG. 15 is a cross-sectional view which illustrates the assembled condition of the essential parts of the embodiment of FIG. 1.

Referring to FIG. 15, illustrated therein is the proper positioning of the alarm setting wheel train of the first embodiment in accordance with the teachings of the present invention during the assembly operation. During assembly, the apertures 24 and 30 are used as setting marks for the primary and secondary alarm setting wheels 10 and 13 which are installed in arbitrarily rotational positions. Specifically, the primary time wheel 16 is positioned relative to the primary alarm setting wheel 10 by aligning the aperature 21 with the aperture 24 and the secondary time wheel 17 is positioned relative to the secondary alarm setting wheel 13 by aligning the aperture 27 with the aperture 30.

Figure 16:
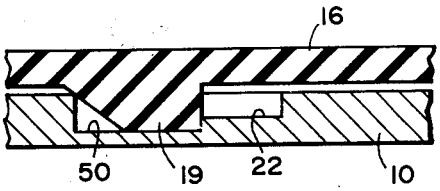
FIGS. 16 and 17 are cross-sections of a second embodiment illustrating a mechanism for positioning the wheels during assembly of a timepiece having an alarm setting device in accordance with the teachings of the present invention.
Figure 17:
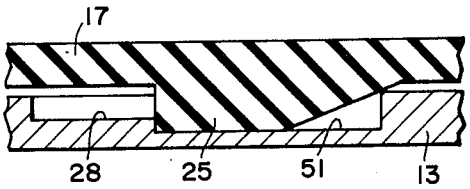

Referring the FIG. 16 and 17, shown therein is a second embodiment for a means for properly positioning the alarm setting wheel train during assembly. In FIG. 16, a further downward step 50 if formed inside a slot 22 in the primary alarm setting wheel 10. Assembly is accomplished by causing the projection 19 on the primary time wheel 16 to contact the step 50. Similarly in FIG. 17, a step 51 is formed inside the slot 28 in the secondary alarm setting wheel 13 and proper alignment for assembly is accomplished by causing projection 25 on the secondary time wheel 17 to contact step 51. Furthermore, it should be apparent to one skilled in the art that although in the described embodiments the movable part of the contact device was formed by a contact spring 32, this movable part could also be formed by a rigid lever acting in conjunction with a separate spring. Furthermore, the movable part and the contact point could also be provided on different parts of the time piece.

As it has been described the alarm setting device provided by this invention controls the on-off condition of the contacts for an acoustic alarm device by means of two cam mechanisms activated by two time wheels revolving at different rates. Accordingly, this invention makes it possible to obtain an alarm setting device in which (a) the time at which the alarm sounds can be set with a high degree of accuracy, (b) the amount of torque loss suffered by the drive train of the time piece is at a minimum, and (c) assembly and operation are simple.

In all cases it is understood that the above described embodiments are merely illustrative but a few of the many possible specific embodiments which represent the applications of the principles of the present invention. Numerous and varied other arrangements can be readily devised by those skilled in the art without departing from the spirit and scope of the invention.

What is claimed is:

1. An alarm setting device for timepieces comprising:

a primary alarm setting wheel which engages with an alarm-hand wheel;

a primary time wheel provided on the same shaft as said primary alarm setting wheel, said primary time wheel being superjacent said primary alarm setting wheel and slidably movable relative thereto, said primary time wheel being driven by a wheel train of said timepiece;

a primary cam mechanism comprising projections provided on said primary time wheel and corresponding slots provided in said primary alarm wheel;

a secondary setting wheel engaging with said primary alarm setting wheel;

a secondary time wheel provided on the same shaft as and superjacent said secondary alarm setting wheel, said secondary time wheel being slidably movable relative to said secondary alarm setting wheel and being driven at a higher rate than said primary time wheel by a wheel train of said timepiece;

a secondary cam mechanism comprising projections provided on said secondary time wheel and corresponding slots in said secondary alarm setting wheel; and a contact means responsive to both said primary and secondary cam mechanisms whereby said contact means is turned on when both said projections in said primary and secondary time wheels engage with and drop into said slots in said primary and secondary alarm setting wheels.

2. An alarm setting device according to claim 1 wherein said primary alarm setting and time wheels are provided with an indicating means for determining the relative positions therebetween during assembly of said timepiece.

3. An alarm setting device according to claim 2 wherein said secondary alarm setting and time wheels are provided with an indicating means for determining the relative positions therebetween during assembly of said timepiece.

4. An alarm setting device according to claim 3 wherein both said primary and secondary time wheels are made from an insulative material.

5. An alarm setting device according to claim 4 further comprising an alarm setting stem coupled to both said primary and secondary alarm setting wheels.

* * * * *